US005398376A

United States Patent [19]

Pollack

[11] Patent Number: 5,398,376

[45] Date of Patent: Mar. 21, 1995

[54] FLEXIBLE HINGE FOR DISPLAY FRAMES AND STANDS

[76] Inventor: Ronald M. Pollack, 53 Burns St., Forest Hills, N.Y. 11375

[21] Appl. No.: 112,136

[22] Filed: Aug. 26, 1993

[51] Int. Cl.[6] ..... E05D 1/00

[52] U.S. Cl. ..... 16/225; 16/DIG. 13

[58] Field of Search ..... 16/225, 227, 277, 354, 16/DIG. 13, DIG. 33, 252, 261; 160/231.1, 231.2

[56] References Cited

U.S. PATENT DOCUMENTS

| | | | |
|---|---|---|---|
| 2,507,965 | 5/1950 | Eichner | 160/231.2 |
| 2,607,411 | 8/1952 | Van Vliet | 160/231.2 |
| 3,314,551 | 4/1967 | Plastow | 160/231.2 |
| 3,592,289 | 7/1971 | Aysta et al. | 160/231.2 |
| 3,889,736 | 6/1975 | Firks | 16/225 |
| 4,438,605 | 3/1984 | DeLucia | 16/225 |
| 4,563,381 | 1/1986 | Woodland | 16/225 |
| 4,670,938 | 6/1987 | Fowlston | 16/DIG. 13 |
| 4,828,132 | 5/1989 | Francis, Jr. et al. | 16/225 |

FOREIGN PATENT DOCUMENTS

| | | | |
|---|---|---|---|
| 3133336A1 | 3/1983 | Germany | 16/225 |

*Primary Examiner*—P. Austin Bradley
*Assistant Examiner*—Chuck Y. Mah
*Attorney, Agent, or Firm*—Galgano & Burke

[57] ABSTRACT

A flexible hinge for releasably joining together display stands, of the type having an elongated frame element having an interior slotted channel. The hinge is composed of at least one resilient hinge element having a central base wall having opposite ends and a pair of arms each joined to an opposite end of the base wall. The arms of the hinge element are slidably insertable in a releasable, friction-fit manner into one of the frame element channels of a pair of adjacent display stands. The hinge element legs flex to generally conform to the configuration of the channel in which they are received and the hinge central base wall extends through the slots of the channels, thereby joining the display stands together.

8 Claims, 2 Drawing Sheets

FLEXIBLE HINGE FOR DISPLAY FRAMES AND STANDS

BACKGROUND OF THE INVENTION

1. Field of the Invention

The present invention relates to a flexible hinge for display stands,, picture frames, poster frames and the like. More particularly, it relates to such a flexible hinge and display stand assembly which may be used to form a multistand display.

In my earlier patents for a picture and a poster frame, U.S. Pat. Nos. 4,669,209 and 4,986,013, the subject matter of which is incorporated herein by reference thereto, I have described picture and poster frames which are very inexpensive and easy to assembly, and which mat be used for the practical framing of a wide variety of pictures, posters, commercial signs, etc., for both residential and commercial use.

The present invention is an accessory to these and similar poster and picture frames to facilitate the coupling of several display frames or Stands together,

SUMMARY OF THE INVENTION

Accordingly, it is an object of the present invention to provide a novel, flexible hinge and display stand and hinge assembly for poster-like pictures, signs and the like which is of simple and inexpensive construction and easy and facile to install.

It is also an object of the present invention to provide such a flexible hinge which allows greater versatility of use in connection with the grouping of different display stands, pictures, or double-sided pictures or signs together in a variety of positions.

Certain of the foregoing and related objects are attained in a flexible hinge for releasably joining together display stands, the display stands each being of the type having an elongated frame element having an interior slotted channel. The hinge includes at least one resilient hinge element having a central base wall having opposite ends and a pair of arms each joined to an opposite end of the base wall. The arms of the hinge element are slidably insertable in a releasable, friction-fit manner into one of the frame element channels of a pair of adjacent display stands, with the hinge element legs flexing to generally conform to the configuration of the channel in which they are received and the hinge central base wall extending through the slots of the channels, thereby joining the display stands together.

Preferably, the hinge element is generally H-shaped and the arms thereof are each joined generally at their midpoints to an opposite end of the base wall. Most desirably, the hinge legs have generally bulbous protuberances on the ends thereof. Desirably, the hinge is made of plastic and a plurality of the hinge elements are employed.

In a particularly preferred embodiment of the invention, a multiple display stand and hinge assembly is provided composed of a plurality of display stands each being of the type having an elongated frame element having an interior slotted channel, and at least one of the aforementioned resilient hinge elements for releasably joining two adjacent stands together. The frame element may have a generally rectilinear base wall having opposite edges and a C-shaped dome member, the ends of which are coupled to opposite edges of the base wall, with the C-shaped dome member defining the channel and being slotted. Alternatively, the frame element has an inverted, generally T-shaped base wall having a base leg and an upstanding leg and a C-shaped dome member jointed to the upstanding leg which defines the channel and which has one edge spaced from an end of the base leg to define a slot opening into the channel.

In a further embodiment of the invention, the flexible hinge comprises at least one generally barbell-shaped resilient hinge element having a flexible central base wall having opposite ends and a pair of enlarged end members joined at opposite ends of said base wall. The end members of the hinge element are slidably insertable in a releasable, friction-fit manner into one of the frame element channels of a pair of adjacent display stands. The hinge element end members are dimensioned and configured to generally conform to the dimensions and configuration of the channel in which they are received for establishing a releasable friction-fit and the hinge central base wall extends through the slots of the channels, thereby joining the display stands together.

BRIEF DESCRIPTION OF THE DRAWINGS

Other objects and features of the present invention will become apparent from the following detailed description considered in connection with the accompanying drawings which disclose several embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENTS

Figure 1:
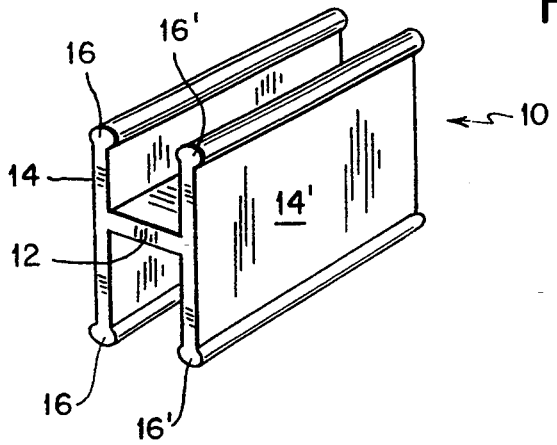
FIG. 1 is a perspective view of the novel flexible hinge embodying the present invention.

Turning now in detail to the drawings, and in particular to FIG. 1 thereof, therein illustrated is a novel, flexible hinge for releasably joining together display stands, embodying the present invention and generally designated by reference numeral 10. Hinge 10 has a generally H-shaped configuration and is made of a resilient plastic having memory. Hinge 10 has a central base wall 12 and a pair of arms 14, 14' each joined generally at their midpoints to an opposite end of base wall 12. Preferably, the ends of the arms 14, 14' are beaded to define a generally bulbous end protrusions 16, 16' which serve to eliminate any sharp edges which could cut the user.

Figure 2:
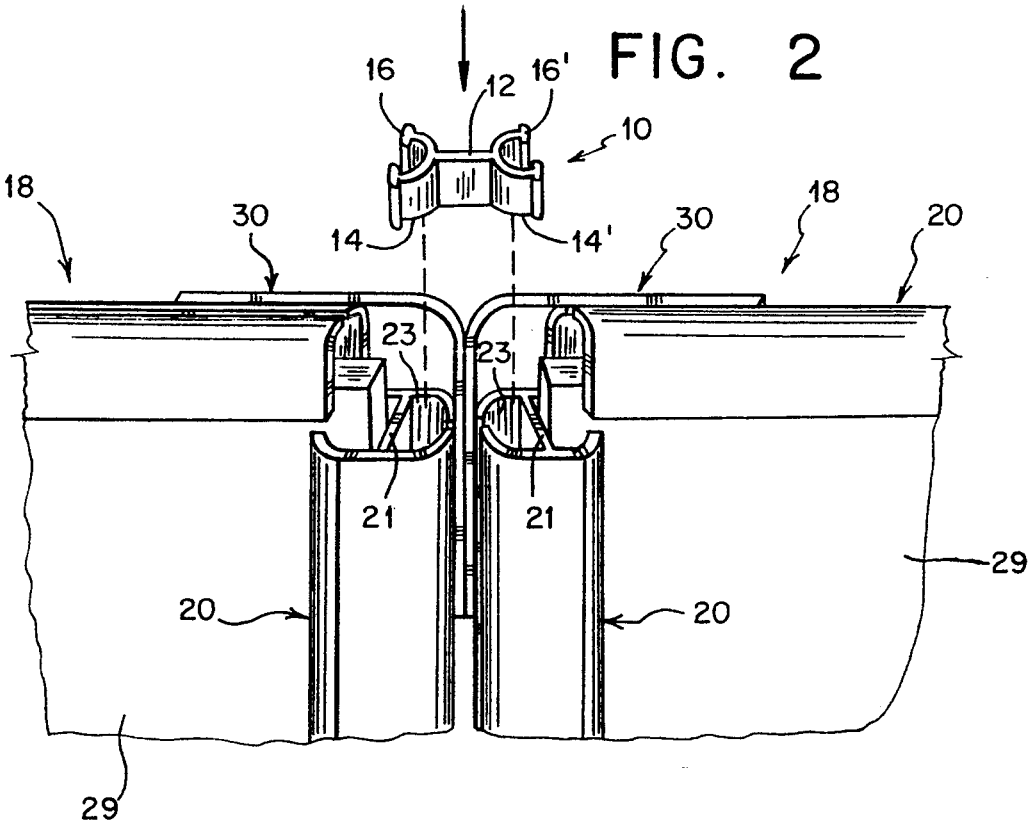
FIG. 2 is a perspective view showing two adjacent display stands being joined by the flexible hinge.

FIG. 2 illustrates two poster frames or stands 18, disposed adjacent to one another, the construction of which is described in greater detail in applicant's prior patent, U.S. Pat. No. 4,986,013. These display stands or poster frames 18, are composed of frame elements or edge supports 20 of the type shown in FIG. 16 of U.S. Pat. No. 4,986,013.

Figure 3:
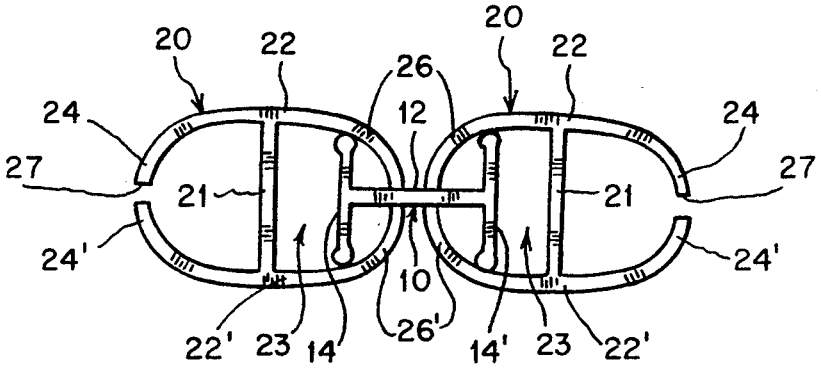
FIG. 3 is a plan view showing the hinge received in the elongated channels of the display stand frame elements.

As seen best in FIG. 3, edge supports 20 each comprise a flat, generally rectilinear base plate 21 having two opposite ends to which a pair of C-shaped dome members 22, 22' are interconnected in a mirror-image fashion. The C-shaped dome members 22, 22' have corresponding opposing legs 24, 24' and 26, 26' the ends of which extend toward and oppose the corresponding ends of the other dome member so as to define a gap or slot 27 between the ends thereof for the purpose of receiving the respective edge of the poster 29. These edge supports 20 are placed on each side of the poster 29 to grab the lateral edges thereof and elbow-shaped corner fastening elements 30 are used, having a substantially C-shaped configuration which basically conforms to the shape of dome member 22 of edge supports 20, but they have an inside diameter slightly smaller than the outside+diameter of element 20, so that a snap fit results when fastening element 30 is engaged with member 20 because of the increased tension therebetween. The details of the construction of these elements are more fully described in the aforementioned patent.

As shown in FIG. 2, two sides of the display stands or poster frames 18 are disposed adjacent to one another so that their edge supports 20 are disposed side by side, closely adjacent to one another. Hinge 10 of the present invention is then slid into the channels 23 defined in the edge supports 20 with leg 14 being received in the channel 20 of one edge support 20 and leg 14' being received in the channel 23 of the other edge support 20, and with the central base wall hinge 12 extending between the two adjacent slots 27 of the two edge supports 20 thereby joining the display stands. 18 together.

Figure 4:
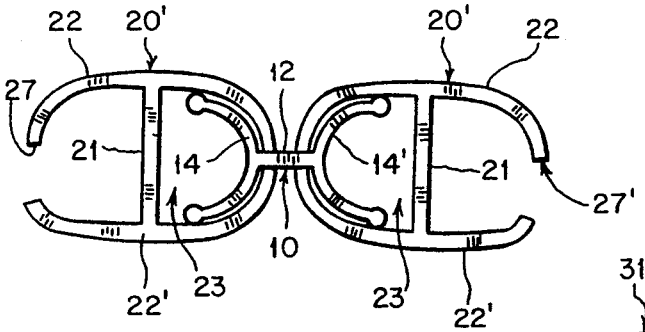
FIG. 4 is a view similar to that of FIG. 3, but showing the same deformed to accommodate the configuration of a somewhat differently configured frame element.

As shown in FIG. 4, due to the flexibility of the hinge 10, the same will deform when inserted to conform to the interior configuration of the channel. FIG. 4 also illustrates a slightly modified edge support 20' having a wider opening inside slot 27' to accommodate a wider poster or picture.

Figure 5:
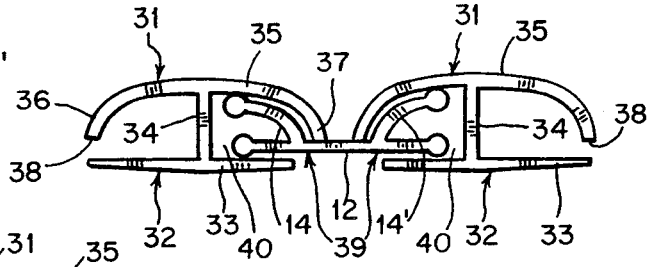
FIG. 5 is a view similar to that of FIGS. 3 and 4, but showing the hinge element deformed to accommodate a different embodiment of the frame element.

FIG. 5 shows use of the hinge 10 with an alternate embodiment of the display stand of the type shown in FIG. 2 of U.S. Pat. No. 4,986,013. In this embodiment, the edge support 31 includes a back plate 32 having a generally inverted T-shaped profile, which is composed of a substantially flat base plate 33 and an upstanding leg 34 disposed centrally and normally thereto. A substantially C-shaped dome member 35 is interconnected to the top end of leg 34 and is provided with legs 36, 37 which curve downwardly toward the lateral edges of base plate 33 to define slots or gaps 38, 39 between the terminus of legs 36, 37 and the ends of base plate 35, respectively. Gaps 38 are sufficient to permit the insertion therein of the edge of a poster-like picture frame (not shown).

As further shown in FIG. 5, the hinge 10 is inserted into channels 40 of edge supports 31 with leg 14 being received in channel 40 of one edge support and 14' in the channel 40 of the other and with the central base wall 12 extending between the slots 39 of the edge supports 31 to join the frames together. Here again, the wings or legs 14, 14' of hinge 10 deform to accommodate this differently configured channel 40.

As can be appreciated, since the entire hinge 10 is made of flexible plastic, the arms or wings 14 can be bent to conform to the general inside shape of the channel of each frame section. Once the hinge is inserted into the frame section, the arms or wings will automatically open, due to the memory of the plastic, to the shape of the inside walls of the profile allowing the easy placement of the small hinge pieces anywhere along the back walls of the frame sections.

Figure 6:
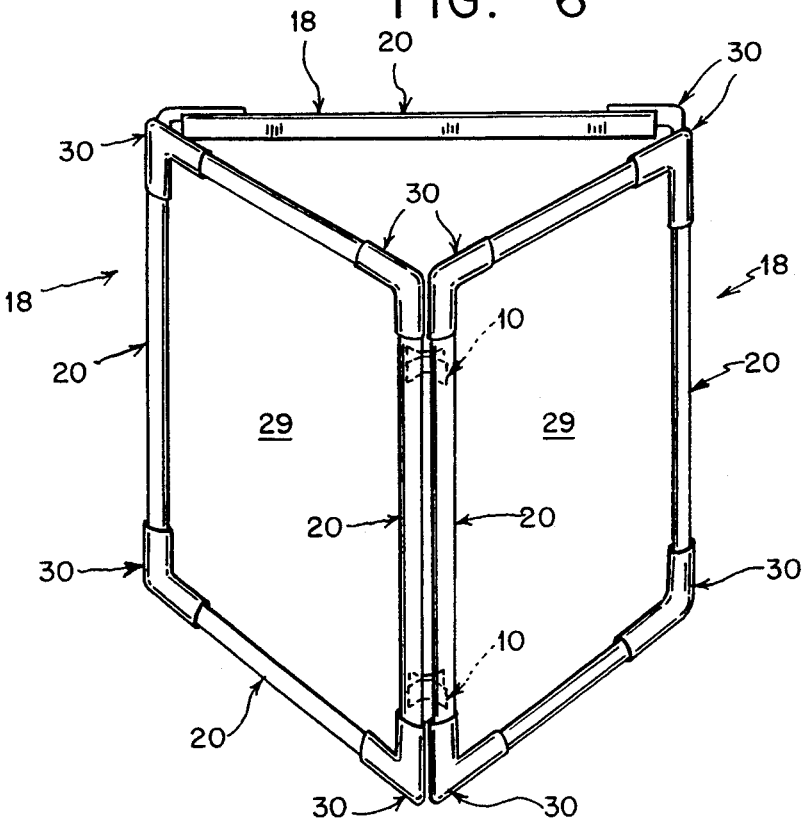
FIG. 6 is a perspective view showing the hinge elements of the present invention being used to form a triangular arrangement of three display stands.

As shown in FIG. 6, several display posters may be joined together so as to form a triangular-type stand as shown in FIG. 6. As can be seen, two hinges are used to join two adjacent display stands together, more or less could be used depending on the size or length of the edge supports. The hinges also provide for additional stability for the standing displays when large sizes are required. Of course, any number of display stands could be so joined together and any preferred arrangement could be employed. In addition, the hinges could be used simply to join adjacent flat display frames or poster together, if desired. Braces and weights could also be used for additional stability at the bottom. See, for example, co-pending application for a display stand or frame brace filed concurrently herewith.

Figure 7:
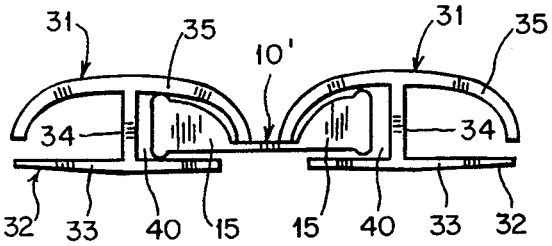
FIG. 7 is a plan view of an alternate embodiment of the present invention.

FIG. 7 discloses an alternate embodiment of the present invention, wherein the resilient hinge 10' in the general form of a barbell having a flexible central base wall 13, having opposite ends and a pair of enlarged end members 15 joined at opposite ends of the base wall 13 which are dimensioned and configured to generally conform to the dimensions and configuration of the channel 40 in which they are received for establishing a releasable, friction fit. In this particular case, the enlarged members 15 would be specifically designed for the intended configuration of the frame element channels 40 and could be made of a completely solid material or of a hollow material, depending upon the intended purpose and needs.

While only several embodiments of the present invention have been shown, various modifications can be made as will be apparent to those skilled in the art. For example, the profile or configuration of the hinges while preferably H-shaped can, of course, be modified to suit the particular application. In addition, the hinge may be made of any suitable plastic or rubber material.

What is claimed is:

1. A flexible hinge for releasably joining together display stands, said display stands each being of the type having an elongated frame element having an interior slotted channel, said hinge comprising:

at least one resilient generally H-shaped, plastic hinge element having a central base wall having opposite ends and a pair of arms each joined generally at their midpoint to an opposite end of said base wall, one of said arms of said hinge element being slidably insertable in a releasable, friction-fit manner into one of the frame element channels of one of a pair of adjacent display stands and the other of said arms of said hinge element being slidably insertable in a releasable friction-fit manner into one of the frame element channels of the other of said pair of adjacent display stands, with said hinge element arms flexing and deforming to generally conform to the configuration of the channel in which they are received and said hinge central base wall extending through the slots of said channels, thereby joining said display stands together.

2. The hinge of claim 1, wherein said hinge arms have generally bulbous protuberances on the ends thereof.

3. The hinge of claim 1, comprising a plurality of said hinge elements.

4. A multiple display stand and hinge assembly, comprising:

a plurality of display stands each being of the type having an elongated frame element having an interior slotted channel; and at least one resilient generally H-shaped, plastic hinge element for releasably joining two adjacent stands together, said hinge element having a central base wall having opposite ends and a pair of arms each joined generally at their midpoint to an opposite end of said base wall, one of said arms of said hinge element being slidably insertable in a releasable, friction-fit manner into one of the frame element channels of one of a pair of adjacent display stands and the other of said arms of said hinge element being slidably insertable in a releasable friction-fit manner into one of the frame element channels of the other of said pair of adjacent display stands, with said hinge element arms flexing and deforming to generally conform to the configuration of the channel in which they are received and said hinge central base wall extending through the slots of said channels, thereby joining said display stands together.

5. The assembly of claim 4, wherein said hinge arms have generally bulbous protuberances on the ends thereof.

6. The assembly of claim 4 comprising a plurality of said hinge elements.

7. The assembly of claim 4, wherein said frame element has a generally rectilinear base wall having opposite edges, and a pair of C-shaped dome members and, the ends of which are coupled to opposite edges of said base wall and wherein said C-shaped dome members defines said channel and is slotted.

8. The assembly of claim 4, wherein said frame element has an inverted, generally T-shaped base wall having a base leg and an upstanding leg and a C-shaped dome member joined to said upstanding leg which defines said channel and which has one edge spaced from an end of said base leg to define a slot opening into said channel.

* * * * *